United States Patent [19]

Wentworth

[11] Patent Number: 4,876,757

[45] Date of Patent: Oct. 31, 1989

[54] TOOL FOR REPLACING NOZZLES ON CAULKING TUBES

[76] Inventor: Michael B. Wentworth, 7015 Buckingham Blvd., Berkeley, Calif. 94705

[21] Appl. No.: 211,209

[22] Filed: Jun. 24, 1988

[51] Int. Cl.[4] ..... B25F 1/04

[52] U.S. Cl. ..... 7/158; 408/28

[58] Field of Search ..... 29/566.1; 408/28; 7/156, 158, 119, 170

[56] References Cited

U.S. PATENT DOCUMENTS

| | | | |
|---|---|---|---|
| 429,515 | 6/1890 | Fred | 7/158 |
| 690,143 | 12/1901 | Grooms | 7/158 X |
| 790,432 | 5/1905 | Heilrath | 7/156 X |
| 1,187,842 | 6/1916 | Kaas | 7/158 X |
| 2,478,063 | 8/1949 | Strauss | 7/158 X |
| 4,284,213 | 8/1981 | Lee | 222/541 |
| 4,328,910 | 5/1982 | Polite, Jr. | 222/81 |

FOREIGN PATENT DOCUMENTS

| | | | |
|---|---|---|---|
| 662111 | 11/1951 | United Kingdom | 7/158 |

*Primary Examiner*—Z. R. Bilinsky

*Attorney, Agent, or Firm*—Townsend and Townsend

[57] ABSTRACT

A tool that allows a user to salvage a tube of caulk after the nozzle has become clogged. The approach is to cut off the nozzle to leave a stub of sufficient length, tap threads into the stub, and screw in a replacement nozzle. The tool comprises a body having a generally semi-cylindrical recess conforming to the base region of the caulking tube nozzle. A blade is mounted in the recess for cutting of the nozzle at a predetermined distance from the base of the nozzle. A tap, suitable for cutting threads into the stub of the nozzle, is rigidly mounted to and protrudes from the body. The tool includes provision for rendering the blade ineffective to cut nozzles or fingers when the tool is being used other than in the cutting mode.

10 Claims, 2 Drawing Sheets

TOOL FOR REPLACING NOZZLES ON CAULKING TUBES

FIELD OF THE INVENTION

The present invention relates generally to tools used in the caulking industry, and more specifically to a tool that allows the user to replace a nozzle on a tube of caulk.

BACKGROUND OF THE INVENTION

People who use caulk face two challenges, getting a new tube started and getting a partially used tube started.

To start a new tube, the user uses a razor knife to cut the tip off the nozzle and then a long nail or coat hanger to puncture the seal at the base of the nozzle. It is far from uncommon for the hole in the tip to end up oversize due to the need to accommodate the nail. The result is an oversize bead.

Starting a partially used tube presents its own set of frustrations. Many a nearly full tube of caulk has become unusable because the caulking material in the nozzle has hardened. While a session with a coat hanger or the like can sometimes re-establish the pathway between the usable caulk in the tube and the tip of the nozzle, such measures tend to be ineffective, and the result is likely to be a series of spurting globs rather than a smooth bead.

A more elegant alternative to the coat hanger approach is disclosed in U.S. Pat. No. 4,284,213. The patent discloses a screw-on caulking nozzle engagable with a threaded nipple on the tube, and a cap having external threads also engagable with the threaded nipple. To start a new tube, one can unscrew the nozzle and break the seal. In the event that the nozzle becomes clogged, it is a simple matter to unscrew it and remove the hardened material with a screwdriver, coat hanger, or other tool of choice.

However, a quick visit to the hardware store will reveal that the vast majority of tubes of caulking material do not have the threaded connection, but rather have a non-removable nozzle.

SUMMARY OF THE INVENTION

The present invention is a compact, simple, safe tool that allows a user to start a new tube of caulk or salvage a partially used tube after the nozzle has become clogged.

In brief, the approach is to cut off the nozzle to leave a stub of sufficient length, tap threads into the stub, and screw in a replacement nozzle. The tool comprises a body having a recess sized to admit at least a portion of the base region of the caulking tube nozzle. The recess is preferably semi-cylindrical. A blade is mounted across the recess for cutting off the nozzle at a predetermined distance from the base of the nozzle. A tap, suitable for cutting threads into the stub of the nozzle, is rigidly mounted to and protrudes from the body.

The tool includes provision for rendering the blade ineffective to cut nozzles or fingers when the tool is being used other than in the cutting mode (either during tapping or storage). In a preferred embodiment, the body consists of two relatively rotatable plate-like body portions. The two body portions abut along an interface plane and are each formed with a cutout. The blade is mounted to one of the body portions, with the cutting edge in the interface plane. In a first relative position of the body portions the cutouts are aligned to define the recess and the blade is exposed, while in a second relative position the cutouts are not aligned, and the blade lies safely flat against the relatively rotated body portion.

The tool may also be provided with a holding element, preferably a plate-like element formed with a semi-cylindrical cutout. This element can screw onto the tap for storage, and is removed from the tool during the tapping operation. The holding element may be used if necessary to bear down on the nozzle stub during tapping or tap withdrawal in the event that the nozzle is otherwise free to rotate relative to the tube.

Thus the user can use the tool to replace the nozzle on a new tube of caulk, making it easy to break the seal without requiring an oversize hole. Similarly, the tool makes it possible to salvage partially use tubes. Moreover, the replaceability of the nozzles allows using nozzles with different sized holes on the same tube.

A further understanding of the nature and advantages of the present invention may be realized by reference to the remaining portions of the specification and the attached drawings.

DESCRIPTION OF THE PREFERRED EMBODIMENT

Figure 1:
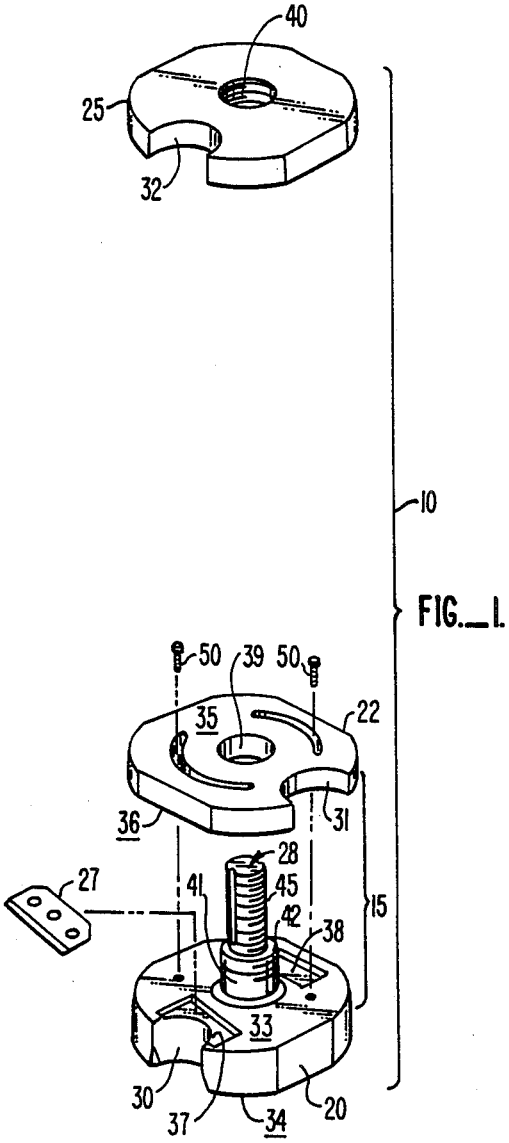
FIG. 1 is a perspective exploded view of a tool according to the present invention.

FIG. 1 is an exploded view of a tool 10 according to the present invention. In brief, the tool is used to start a new tube or salvage a tube whose nozzle has become clogged with hardened caulking material. To this end, the tool is configured to cut off the nozzle, leaving a stub, and thereafter to tap threads into the stub so that a new nozzle having suitable external threads can be screwed on. In order to render the tool suitable for use in performing these operations, the tool includes relatively movable portions and removable portions, as will be described in greater detail below.

Tool 10 comprises a body having first and second relatively rotatable plate-like body portions 20 and 22, a removable holding element 25, a replaceable blade 27, and a tap 28 mounted to first body portion 20. The tool is shown with tap 28 extending upwardly along a vertical axis with the body portions and holding element in horizontal planes. While some elements will be described below in terms of this orientation, it is to be understood that the tool can be used in any orientation.

Body portions 20 and 22 and holding element 25 are generally circular with flats on three sides and respective cutouts 30, 31, and 32 along the fourth side (where the flat would otherwise be). The cutouts are preferably approximately semi-cylindrical so as to conform to the base region of the nozzle. However, other shapes, such as rectangular, are possible, so long as the base of the nozzle can fit far enough into the cutouts to be cut by the blade (as described below). The cutouts, when aligned, define a recess along the peripheral wall. First body portion 20 has an upper surface 33 and a lower surface 34, and second body portion 22 has an upper surface 35 and a lower surface 36. The body portions interface along surfaces 33 and 36. Body portion 20 is formed with a recess 37 in surface 33 sized to hold blade 27 in the position such that the blade extends across cutout 32 with its edge slightly spaced radially inwardly. Recess 37 is of a depth equal to the blade thickness so that the blade edge is substantially flush with surface 33. An additional recess 38, formed away from the edges of body portion 20 is sized to hold one or more spare blades. Second body portion 22 is formed with a central aperture 39 and holding element 25 is formed with a threaded central aperture 40.

Tap 30 is rigidly mounted to body portion 20. The portion upstanding from surface 3 of body portion 20 includes an unthreaded shoulder 40 sized for aperture 38, a threaded shoulder 42 sized for aperture 39, and a fluted tapping portion 45.

Figure 2A:
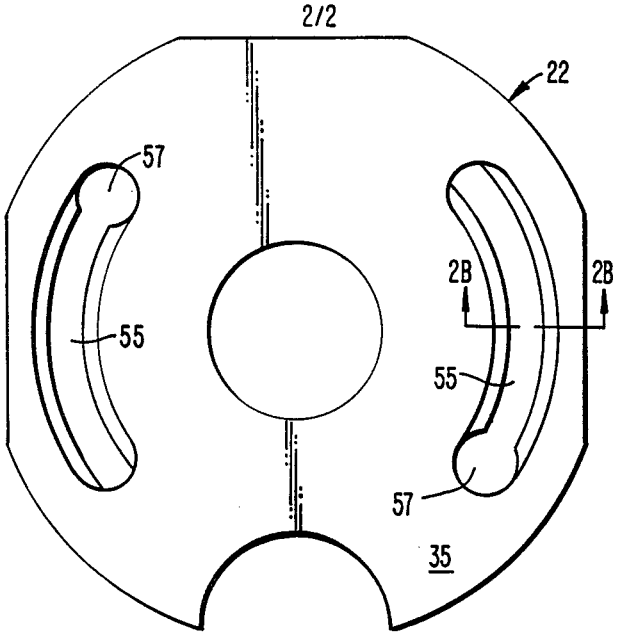
FIG. 2A is a top plan view of the second body portion.
Figure 2B:
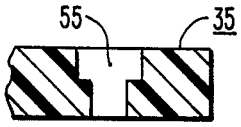
FIG. 2B is a sectional view taken through line 2B—2B of FIG. 2A.

FIGS. 2A–B are detail views showing the configuration of body portion 22. Second body portion 22 cooperates with a pair of pins 50 mounted rigidly to first body portion 20 in order to provide a rotational and removable connection. Body portion 22 is formed with shouldered slots 55, each in the form of a circular arc, and each terminating in a through hole 57. Pins 50 are formed of a somewhat resilient material (plastic) with split heads that require some degree of compression for the heads to pass through holes 57. The body portions are assembled by squeezing pins 50 to pass through holes 57 and twisting body portion 22 so that it is captured by the heads of the pins. Disassembly, to change blades for example, can be accomplished by prying the two body portions apart.

Figure 3:
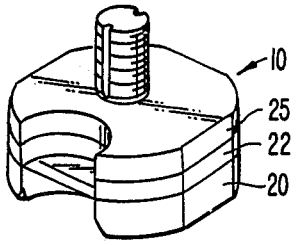
FIG. 3 is a perspective view of the tool in a position for cutting.

FIG. 3 shows the assembled tool in a first position for cutting. In this position, body portion 22 has been placed atop body portion 20 with holes 57 aligned with pins 50, and twisted so that the semi-cylindrical cutouts are aligned, thereby exposing the blade. In this position, the tool is manipulated with lower surface 34 of first body portion 20 against the caulking tube and the blade against the nozzle. The tube is twisted, whereupon the nozzle is cut off to leave a stub. The diameter of tapping portion 45 and the thickness of first body portion are constrained by the nozzle dimensions near the base. The nozzle must be cut off at a distance where the internal diameter is suitable to accommodate the tap. For a half-inch tap, a body portion thickness of about 7/16 inch provides the right diameter stub for the great majority of caulking tubes on the market. Second body portion 22 and holding element 25 are generally thinner than first body portion 20.

Figure 4:
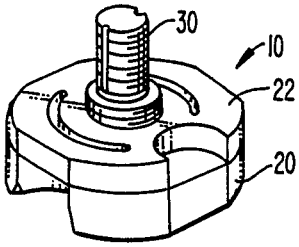
FIG. 4 is a view of the tapping position, with the blade guarded and the holding element removed.

FIG. 4 shows the tool 10 in position for tapping. Holding element 25 has been removed, and second body portion 22 has been twisted by 90° in order to allow its semi-cylindrical cutout to be away from the blade. Thus, the blade edge lies snugly against lower surface 36 of body portion 22 and presents no hazard to the user. With the tool in this position, tap 30 is inserted into the stub that was left in the previous operation, and threads cut therein. Holding element 25 may be used during tapping and tap withdrawal if it turns out that the tube is one of the type where the nozzle is relatively free to rotate. In such a case, the holding element's cutout is pushed against the stub to prevent rotation.

Figure 5:
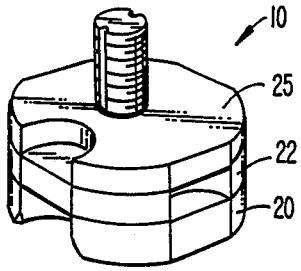
FIG. 5 is a view of the tool in a storage position.

FIG. 5 shows tool 10 in a storage position in which body portion 22 has been twisted into the safety position (corresponding to FIG. 4) and holding element 25 screwed onto threaded shoulder 42 to lock the parts of the tool rigidly together. The blade is not exposed and all the parts are held together.

In conclusion, it can be seen that the present invention provides a simple tool, safe and convenient for the user, to enable tubes of caulk, otherwise unsalvagable, to be used to their fullest. While the above is a complete description of the preferred embodiment of the invention, alternative constructions, modifications, and equivalents may be used. Therefore, the above description and illustrations should not be taken as limiting the scope of the present invention which is defined by the appended claims.

I claim:

1. A tool for allowing a user to replace the nozzle on a caulking tube, comprising:

a body;

a blade mounted to said body;

guard means for selectively exposing said blade;

means adapted to contact the caulking tube, for positioning said blade, when exposed, relative to said nozzle to enable cutting the nozzle so as to leave a stub of predetermined length; and a tap sized to cut internal threads in the stub, rigidly mounted to said body.

2. The tool of claim 1 wherein said positioning means comprises portions on said body defining an external surface spaced from said blade.

3. A tool for allowing a user to replace the nozzle on a caulking tube, comprising:

a body having a flat end face and a peripheral wall, said peripheral wall being formed with a recess sized to accommodate at least a portion of the base region of the nozzle;

a blade mounted within said recess so that it is in a plane parallel to said end face and spaced a predetermined distance therefrom, said blade having an outwardly pointing edge spaced inwardly from said peripheral wall;

guard means for selectively exposing said blade, said guard means and said blade being relatively movable from a first position where said recess extends along said peripheral wall with said blade edge exposed to enable cutting the nozzle so as to leave a stub, and a second position wherein said recess is interrupted so that said blade edge is not exposed; and a tap sized to cut internal threads in the stub, mounted to and extending outwardly from said body.

4. The tool of claim 3 wherein said cutout is generally semi-cylindrical.

5. The tool of claim 3 wherein said body comprises first and second relatively rotatable portions, each having a cutout, and wherein said first and second body portions together define said guard means with said first position having said cutout portions aligned and said second position having said cutout portions out of alignment.

6. The tool of claim 3, and further comprising a removable element, formed with a semi-cylindrical cutout for holding the stub to prevent rotation thereof.

7. A tool for allowing a user to replace the nozzle on a caulking tube, comprising:

a body having first and second faces and having first and second plate-like portions, relatively rotatable about an axis and abutting along an interface plane perpendicular to said axis, each of said plate-like portions being formed with a generally semi-cylindrical cutout in its periphery;

said body portions having a first relative position with the respective cutouts aligned and a second position with the respective cutouts out of alignment;

a blade mounted to one of said body portions generally parallel to said interface plane, said blade being spaced inwardly from the periphery; and a tap mounted rigidly to one of said body portions and extending along said axis out from said second face.

8. The tool of claim 7 wherein said tap is mounted to said first body portion.

9. The tool of claim 7 wherein said blade is mounted to said first body portion generally in said interface plane.

10. The tool of claim 7, and further comprising a plate-like holding element, engagable with said body, and having a generally semi-cylindrical cutout matching said semi-cylindrical cutouts of said first and second body portions.

* * * * *